US011292690B2

(12) United States Patent
Hsu

(10) Patent No.: US 11,292,690 B2
(45) Date of Patent: Apr. 5, 2022

(54) CAPACITY SHIFTING BETWEEN PARTIALLY-OVERLAPPING ELEVATOR GROUPS

(71) Applicant: OTIS ELEVATOR COMPANY, Farmington, CT (US)

(72) Inventor: Arthur Hsu, South Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 924 days.

(21) Appl. No.: 16/044,792

(22) Filed: Jul. 25, 2018

(65) Prior Publication Data

US 2020/0031615 A1 Jan. 30, 2020

(51) Int. Cl.

| | |
|---|---|
| ***B66B 1/38*** | (2006.01) |
| ***B66B 1/24*** | (2006.01) |
| ***B66B 1/34*** | (2006.01) |

(52) U.S. Cl.

CPC ..... *B66B 1/38* (2013.01); *B66B 1/24* (2013.01); *B66B 1/3407* (2013.01); *B66B 2201/401* (2013.01); *B66B 2201/403* (2013.01)

(58) Field of Classification Search

CPC ..... B66B 1/38; B66B 1/24; B66B 1/3407; B66B 2201/401; B66B 2201/403

USPC ..... 187/247

See application file for complete search history.

(56) References Cited

U.S. PATENT DOCUMENTS

| | | | |
|---|---|---|---|
| 7,198,136 | B2 | 4/2007 | Urata |
| 7,360,629 | B2 | 4/2008 | Hagi et al. |
| 7,537,089 | B2 | 5/2009 | Duenser et al. |
| 7,621,376 | B2 | 11/2009 | Duenser et al. |
| 7,650,966 | B2 | 1/2010 | Sansevero et al. |
| 7,784,588 | B2 | 8/2010 | Sikshin et al. |

(Continued)

FOREIGN PATENT DOCUMENTS

| | | | |
|---|---|---|---|
| CN | 101588978 | A | 11/2009 |
| CN | 102196981 | A | 9/2011 |

(Continued)

OTHER PUBLICATIONS

The Extended European Search Report for Application No. 19188481.6-1017 / 3599199; dated Mar. 12, 2020; Mar. 20, 2020; 11 pages.

(Continued)

*Primary Examiner* — Jeffrey Donels

(74) *Attorney, Agent, or Firm* — Cantor Colburn LLP

(57) ABSTRACT

A method of operating a building elevator system within a building having a plurality of landings including: controlling a first elevator group; controlling a second elevator group; adjusting a range of landings served by one or more elevator systems of the second elevator group in response to at least one of the predicted passenger response time, the time of day, the amount of traffic received by the first elevator group, the amount of traffic received by the second elevator group, the amount of traffic within the first range of landings, the amount of traffic within the second range of landings, the amount of traffic received by the first elevator group relative to the amount of traffic received by the second elevator group, and the amount of traffic within the first range of landings relative to an amount of traffic within the second range of landings.

18 Claims, 5 Drawing Sheets

(56) References Cited

U.S. PATENT DOCUMENTS

| | | | | |
|---|---|---|---|---|
| 7,841,450 | B2 | 11/2010 | Smith et al. | |
| 8,210,321 | B2 | 7/2012 | Finschi et al. | |
| 8,387,756 | B2 | 3/2013 | Laihanen et al. | |
| 9,950,901 | B2 * | 4/2018 | Bjorni | B66B 9/00 |
| 2004/0163895 | A1 * | 8/2004 | Kostka | B66B 1/20 187/383 |
| 2014/0174861 | A1 * | 6/2014 | Sarjanen | B66B 5/0037 187/387 |
| 2015/0158694 | A1 * | 6/2015 | Finschi | B66B 1/2458 187/247 |
| 2017/0001829 | A1 | 1/2017 | Jetter et al. | |
| 2017/0190544 | A1 | 7/2017 | Witczak et al. | |
| 2017/0210594 | A1 | 7/2017 | Gerstenmeyer et al. | |
| 2018/0086598 | A1 | 3/2018 | Thebeau et al. | |
| 2019/0300328 | A1 * | 10/2019 | Stanley | B66B 1/18 |

FOREIGN PATENT DOCUMENTS

| | | | |
|---|---|---|---|
| CN | 102540885 | A | 7/2012 |
| CN | 102753464 | A | 10/2012 |
| CN | 102762475 | A | 10/2012 |
| CN | 103935850 | A | 7/2014 |
| ES | 2536799 | | 5/2015 |
| WO | 03101874 | A1 | 12/2003 |
| WO | 2004058616 | A1 | 7/2004 |
| WO | 2010046522 | A1 | 4/2010 |
| WO | 2015109166 | A1 | 7/2015 |
| WO | 2017088904 | A1 | 6/2017 |

OTHER PUBLICATIONS

First Chinese Office Action for Application No. 201910672675.3; Office Action dated Jun. 9, 2021; Office Action; 12 pages.

* cited by examiner

CAPACITY SHIFTING BETWEEN PARTIALLY-OVERLAPPING ELEVATOR GROUPS

BACKGROUND

The subject matter disclosed herein relates generally to the field of elevator systems, and specifically to a method and apparatus for coordinating the operation of multiple elevator systems split into groups.

Commonly, elevator cars are organized into elevator groups serving a range of landings of a building rather than each elevator car serving every floor of a building. Once established, the ranges of landings typically remain unchanged due to physical constraints in the elevator system. In conventional elevator systems, a building may have several groups where the floors served by one group do not overlap with the floors served by any other group except, perhaps, the main lobby or other special floors.

BRIEF SUMMARY

According to an embodiment, a method of operating a building elevator system within a building having a plurality of landings is provided. The method including: controlling a first elevator group including one or more elevator systems, wherein each of the one or more elevator systems of the first elevator group includes an elevator car configured to serve a first range of landings; controlling a second elevator group including one or more elevator systems, wherein each of the one or more elevator systems of the second elevator group include an elevator car configured to serve a second range of landings; detecting at least one of a predicted passenger response time, a time of day, an amount of traffic received by the first elevator group, an amount of traffic received by the second elevator group, an amount of traffic within the first range of landings, an amount of traffic within the second range of landings, the amount of traffic received by the first elevator group relative to the amount of traffic received by the second elevator group, and the amount of traffic within the first range of landings relative to the amount of traffic within the second range of landings; and adjusting a range of landings served by one or more elevator systems of the second elevator group in response to at least one of the predicted passenger response time, the time of day, the amount of traffic received by the first elevator group, the amount of traffic received by the second elevator group, the amount of traffic within the first range of landings, the amount of traffic within the second range of landings, the amount of traffic received by the first elevator group relative to the amount of traffic received by the second elevator group, and the amount of traffic within the first range of landings relative to an amount of traffic within the second range of landings.

In addition to one or more of the features described herein, or as an alternative, further embodiments may include that the range of landings served by one or more elevator systems of the second elevator group is adjusted to serve one or more landings gravitationally above the second range of landings.

In addition to one or more of the features described herein, or as an alternative, further embodiments may include that the range of landings served by one or more elevator systems of the second elevator group is adjusted to serve one or more landings gravitationally below the second range of landings.

In addition to one or more of the features described herein, or as an alternative, further embodiments may include that the range of landings served by one or more elevator systems of the second elevator group is adjusted to serve one or more landings of the first range of landings.

In addition to one or more of the features described herein, or as an alternative, further embodiments may include that prior to adjusting a range of landings the first range of landings does not include landings within the second range of landings with the exception of an egress landing.

In addition to one or more of the features described herein, or as an alternative, further embodiments may include that the first range of landings is a lower range of landings and the second range of landings is a higher range of landings located at a higher elevation than the lower range of landings with the exception of an egress landing.

In addition to one or more of the features described herein, or as an alternative, further embodiments may include: receiving an elevator call for a landing within the first range of landings; and moving an elevator car of the one or more elevator systems of the second elevator group to the landing within the first range of landings.

In addition to one or more of the features described herein, or as an alternative, further embodiments may include: receiving an elevator call for a landing within the first range of landings; determining an elevator car of the one or more elevator systems of the first elevator group or an elevator car of the one or more elevator systems of the second elevator group to best serve the elevator call in response to a relative amount of traffic with the first range of landings and the second range of landings; and moving the elevator car determined to the landing within the first range of landings.

According to another embodiment, a method of operating a building elevator system within a building having a plurality of landings is provide. The method including: controlling a first elevator group including one or more elevator systems, wherein each of the one or more elevator systems of the first elevator group includes an elevator car configured to serve a first range of landings; controlling a second elevator group including one or more elevator systems, wherein each of the one or more elevator systems of the second elevator group include an elevator car configured to serve a second range of landings; detecting at least one of a predicted passenger response time, a time of day, an amount of traffic received by the first elevator group, an amount of traffic received by the second elevator group, an amount of traffic within the first range of landings, an amount of traffic within the second range of landings, the amount of traffic received by the first elevator group relative to the amount of traffic received by the second elevator group, and the amount of traffic within the first range of landings relative to the amount of traffic within the second range of landings; and adjusting a range of landings served by one or more elevator systems of the first elevator group in response to at least one of the predicted passenger response time, the time of day, the amount of traffic received by the first elevator group, the amount of traffic received by the second elevator group, the amount of traffic within the first range of landings, the amount of traffic within the second range of landings, the amount of traffic received by the first elevator group relative to the amount of traffic received by the second elevator group, and the amount of traffic within the first range of landings relative to an amount of traffic within the second range of landings.

In addition to one or more of the features described herein, or as an alternative, further embodiments may include that the range of landings served by one or more elevator systems of the first elevator group is adjusted to serve one or more landings gravitationally above the first range of landings.

In addition to one or more of the features described herein, or as an alternative, further embodiments may include that the range of landings served by one or more elevator systems of the first elevator group is adjusted to serve one or more landings gravitationally below the first range of landings.

In addition to one or more of the features described herein, or as an alternative, further embodiments may include that the range of landings served by one or more elevator systems of the first elevator group is adjusted to serve one or more landings of the second range of landings.

In addition to one or more of the features described herein, or as an alternative, further embodiments may include that prior to adjusting a range of landings the first range of landings does not include landings within the second range of landings with the exception of an egress landing.

In addition to one or more of the features described herein, or as an alternative, further embodiments may include that the first range of landings is a lower range of landings and the second range of landings is a higher range of landings located at a higher elevation than the lower range of landings with the exception of an egress landing.

In addition to one or more of the features described herein, or as an alternative, further embodiments may include: receiving an elevator call for a landing within the second range of landings; moving an elevator car of the one or more elevator systems of the first elevator group to the landing within the second range of landings.

In addition to one or more of the features described herein, or as an alternative, further embodiments may include: receiving an elevator call for a landing within the second range of landings; determining an elevator car of the one or more elevator systems of the first elevator group or an elevator car of the one or more elevator systems of the second elevator group to best serve the elevator call in response to a relative amount of traffic with the first range of landings and the second range of landings; and moving the elevator car determined to the landing within the second range of landings.

According to another embodiment, a building elevator system is provided. The building elevator system including: a processor; a memory including computer-executable instructions that, when executed by the processor, cause the processor to perform operations, the operations including: controlling a first elevator group including one or more elevator systems, wherein each of the one or more elevator systems of the first elevator group includes an elevator car configured to serve a first range of landings; controlling a second elevator group including one or more elevator systems, wherein each of the one or more elevator systems of the second elevator group include an elevator car configured to serve a second range of landings; detecting at least one of a predicted passenger response time, a time of day, an amount of traffic received by the first elevator group, an amount of traffic received by the second elevator group, an amount of traffic within the first range of landings, an amount of traffic within the second range of landings, the amount of traffic received by the first elevator group relative to the amount of traffic received by the second elevator group, and the amount of traffic within the first range of landings relative to the amount of traffic within the second range of landings; and adjusting a range of landings served by one or more elevator systems of the second elevator group in response to at least one of the predicted passenger response time, the time of day, the amount of traffic received by the first elevator group, the amount of traffic received by the second elevator group, the amount of traffic within the first range of landings, the amount of traffic within the second range of landings, the amount of traffic received by the first elevator group relative to the amount of traffic received by the second elevator group, and the amount of traffic within the first range of landings relative to an amount of traffic within the second range of landings.

In addition to one or more of the features described herein, or as an alternative, further embodiments may include that the range of landings served by one or more elevator systems of the second elevator group is adjusted to serve one or more landings gravitationally above the second range of landings.

In addition to one or more of the features described herein, or as an alternative, further embodiments may include that the range of landings served by one or more elevator systems of the second elevator group is adjusted to serve one or more landings gravitationally below the second range of landings.

In addition to one or more of the features described herein, or as an alternative, further embodiments may include that the range of landings served by one or more elevator systems of the second elevator group is adjusted to serve one or more landings of the first range of landings.

Technical effects of embodiments of the present disclosure include organizing elevator systems into groups serving a range of landings and determining when an elevator car from one elevator group may serve another elevator group in overlapping landings.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
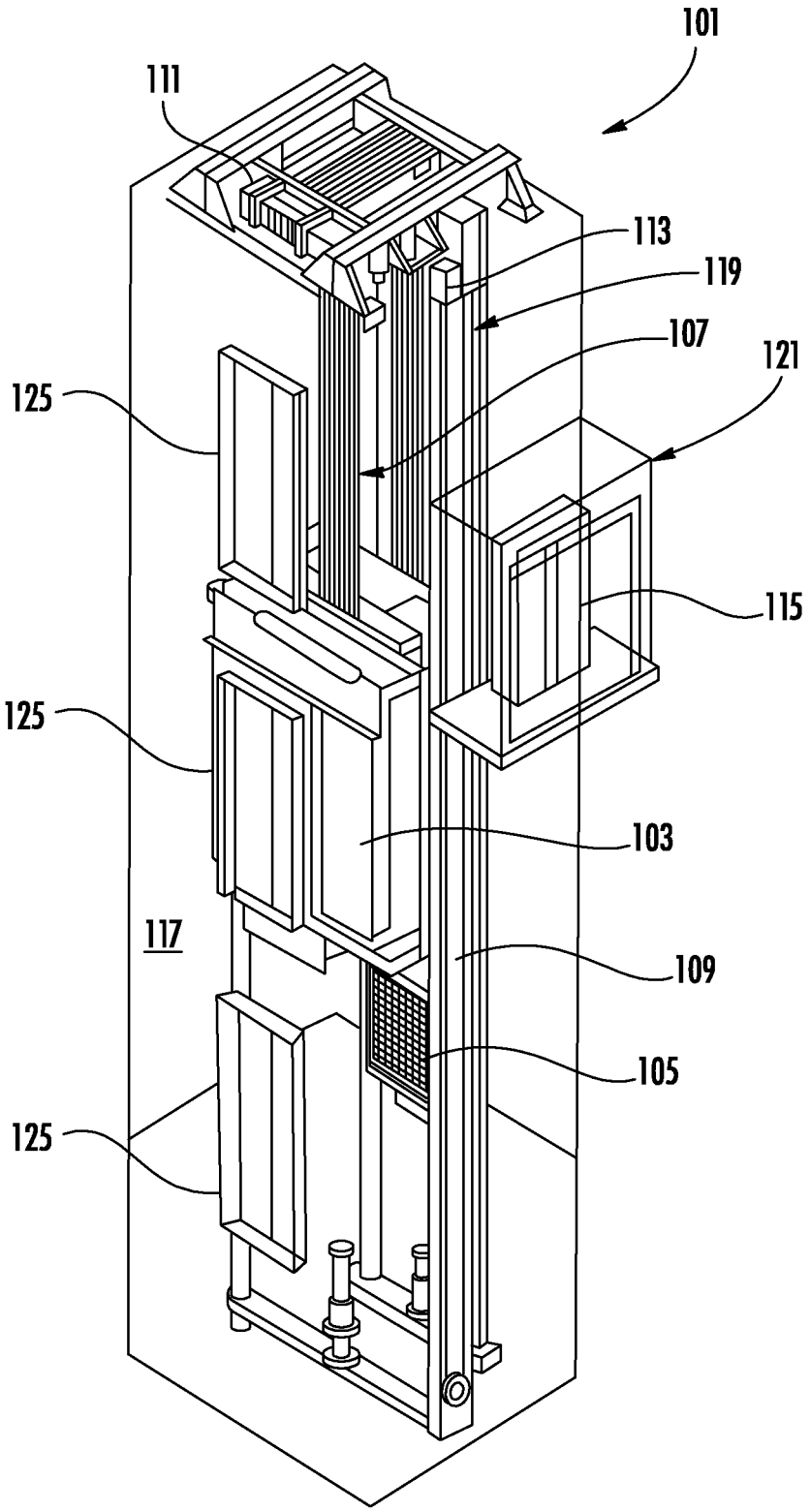
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
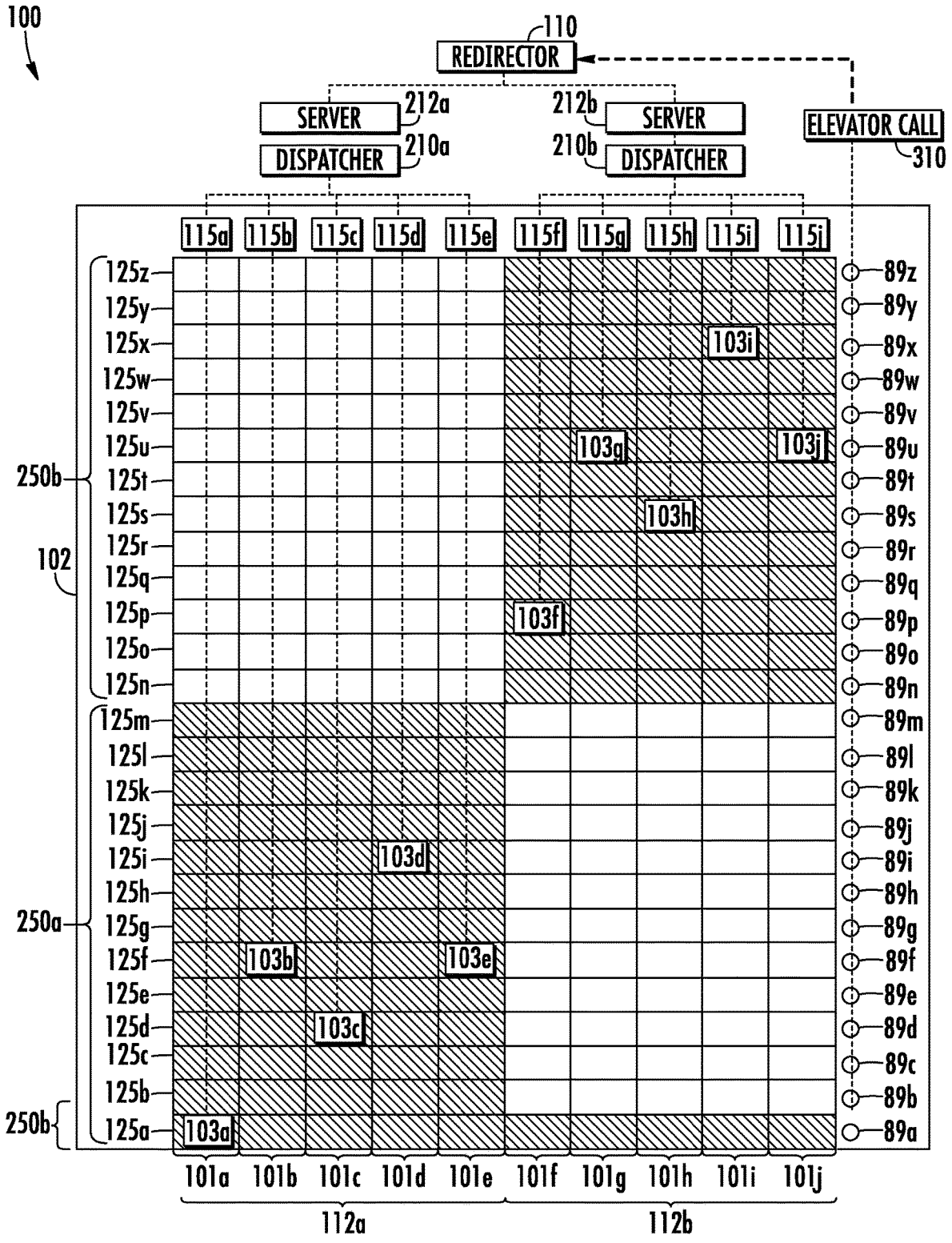
FIG. 2 illustrates a schematic view of a building elevator system, in accordance with an embodiment of the disclosure.
Figure 3:
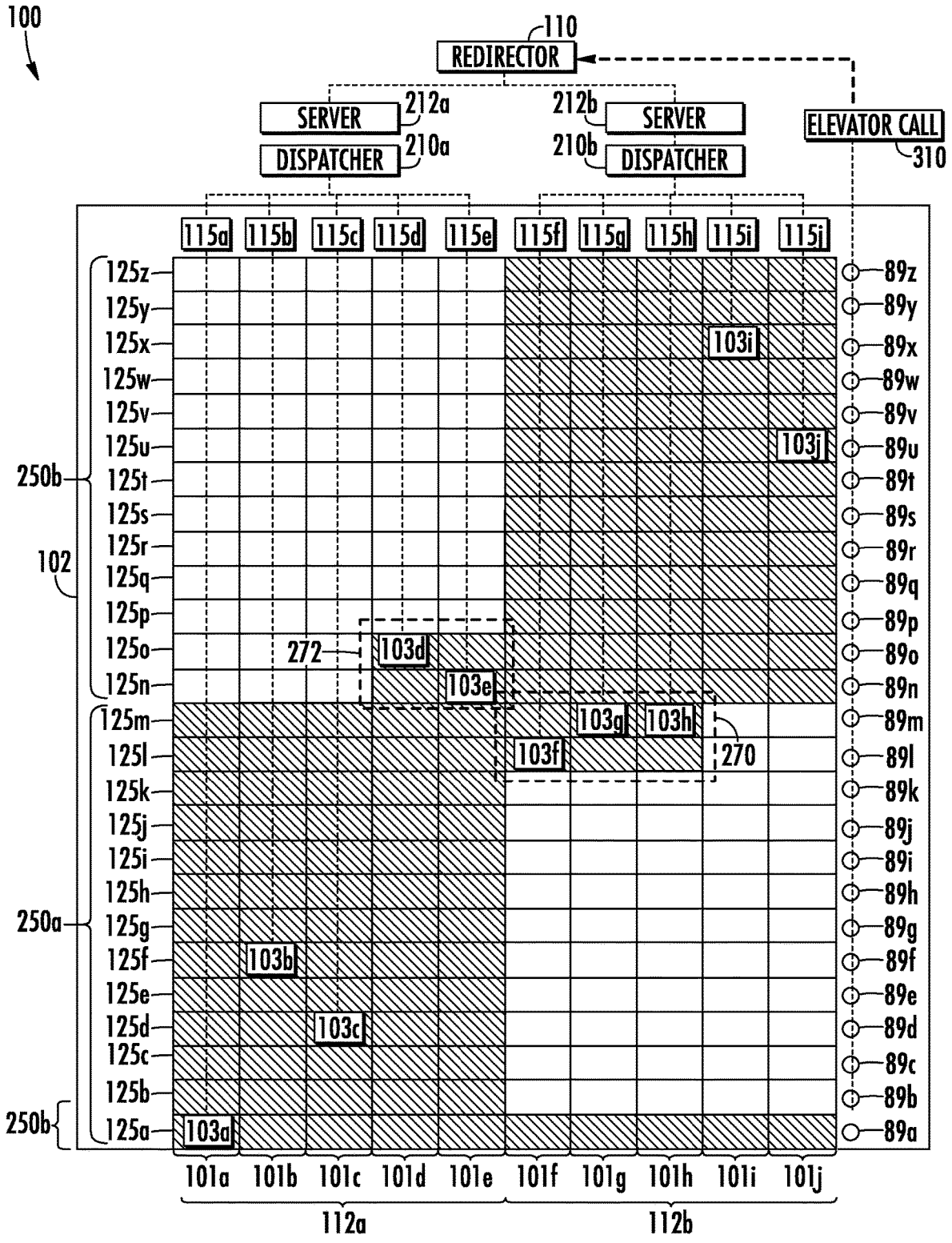
FIG. 3 illustrates a schematic view of a building elevator system, in accordance with an embodiment of the disclosure

Referring now to FIG. 2-3 with continued reference to FIG. 1. As seen in FIG. 2, a building elevator system 100 within a building 102 may include multiple different individual elevator systems 101*a*-101*j* organized in elevator groups 112*a*-112*b*. It is understood that while ten elevator systems 101*a*-101*j* are utilized for exemplary illustration, embodiments disclosed herein may be applied to building elevator systems 100 having two or more elevator systems 101. It is also understood that while twenty-six landings 125*a*-125*z* are utilized for exemplary illustration, embodiments disclosed herein may be applied to building elevator systems 100 having any number of landings.

Further, the elevator systems 101*a*-101*j* illustrated in FIG. 2 is organized into two elevator groups 112*a*, 112*b* for ease of explanation but it is understood that the elevator systems 101*a*-101*j* may be organized into one or more elevator groups. Each elevator group 112*a*-112*b* may contain one or more elevator systems 101. Elevator cars 103 in the same group typically have the characteristic that: the elevator machines are in physical proximity, the hoistways are physically located so that elevator doors on a given landing are served by the same lobby space, the elevator controllers are operably connected in a common communication network, the elevator controllers are assigned elevator calls by a common group controller, and/or share common emergency power components. During normal operation, a first elevator group 112*a* serves a first range of landings 250*a* (i.e., a lower range of landing) comprising landings 125*a*-125*m*. During normal operation, a second elevator group 112*b* serves a second range of landings 250*b* (i.e., a higher range of landings) comprising landings 125*n*-125*z* and landing 125*a* (e.g., egress landing, ground landing, lobby landing, or exit landing). The higher range of landings is located at a higher elevation than the lower range of landings. It is understood that while each elevator group 112*a*-112*b* serves only one range of landings 250 for exemplary illustration, embodiments disclosed herein may include elevator groups having multiple elevator systems where each elevator system in a single elevator group serves a different range of landings or any number of elevators serve any select group of continuous or non-continuous landings.

Each landing 125*a*-125*z* in the building 102 of FIG. 2 may have a destination entry device 89*a*-89*z*. The elevator destination entry device 89*a*-89*z* sends an elevator call 310 to a redirector 110 including the source of the elevator call 310 and the destination of the elevator call 310. The destination entry device 89*a*-89*z* may serve one or more elevator groups 112*a*-112*b*. The destination entry device 89*a*-89*z* may be a push button and/or a touch screen and may be activated manually or automatically. For example, the elevator call 310 may be sent by an individual entering the elevator call 310 via the destination entry device 89*a*-89*z*. The destination entry device 89*a*-89*z* may also be activated to send an elevator call 310 by voice recognition or a passenger detection mechanism in the hallway, such as, for example a weight sensing device, a visual recognition device, and a laser detection device. The destination entry device 89*a*-89*z* may be activated to send an elevator call 310 through an automatic elevator call system that automatically initiates an elevator call 310 when an individual is determined to be moving towards the elevator system in order to call an elevator or when an individual is scheduled to activate the destination entry device 89*a*-89*z*. The destination entry device 89*a*-89*z* may also be a mobile device configured to transmit and elevator call 310. The mobile device may be a smart phone, smart watch, laptop, or any other mobile device known to one of skill in the art. It is understood that while a redirector 110 is used for exemplary illustration, embodiments disclosed herein may be applicable to elevator systems 101 with different elevator call control methods, such as, for example, a traditional two-button interface with hall call buttons (up/down) at the landings and car call buttons (with destination floors) inside the elevator car 103.

The redirector 110 may be in communication with the controller 115*a*-115*j* of each elevator system 101*a*-101*j* through a dispatcher 210*a*-210*b* and a server 212*a*-212*b*, as shown in FIG. 2. The dispatchers 210*a*-210*b* may comprise group control software that is configured to select the best elevator car 103*a*-103*j* within the range of landings 250 assigned to the dispatcher 210*a*-210*b*. The dispatcher 210*a*-210*b* may be an electronic controller including a processor and an associated memory comprising computer-executable instructions that, when executed by the processor, cause the processor to perform various operations. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium. It is understood that while destination entry devices 89*a*-89*z* are used for exemplary illustration, embodiments disclosed herein may be applicable to elevator systems 101 with different elevator call control architectures.

The servers 212*a*-212*b* are similar to a redirector 110 being that the servers 212*a*-212*b* manages the destination entry devices 89*a*-89*z* related to a particular group 112*a*-112*b* (e.g., the redirector 110 interfaces with destination entry devices 89*a*-89*z* that are shared between groups 112*a*-112*b*). In an embodiment, the servers 212*a*-212*b* may be configured to operate as a pass through between the redirector 110 and the dispatcher 210*a*-210*b* associated with the server 212*a*-212*b*.

The controllers 115*a*-115*j* can be combined, local, remote, cloud, etc. The redirector 110 is configured to control and coordinate operation of multiple elevator systems 101*a*-101*j*. The redirector 110 may be an electronic controller including a processor and an associated memory comprising computer-executable instructions that, when executed by the processor, cause the processor to perform various operations. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

The redirector 110 is in communication with each of the elevator destination entry devices 89*a*-89*z* of the building elevator system 100, which are shared by more than one group 112*a*-112*b*. The first range of landings 250*a* or the second range of landings 250*b* may be adjusted in response to at least one of a time of day and an intensity of traffic within each of the first range of landings 250*a* and the second first range of landings 250*b*. If the redirector 110 is monitoring the elevator calls 310 coming in from the elevator destination entry devices 89*a*-89*z* and determines that the one of the elevator groups 112*a*-112*b* needs additional assistances answering the calls then the redirector 110 may adjust the range of landings served by one or more elevator systems 101. The redirector may be remote, local, cloud, or any combinations thereof.

As shown in the example of FIG. 3 at block 270, if the first elevator group 112*a* is experiencing an increased quantity of elevator calls 310 then the range of landings served by one or more elevators systems 101*f*-101*h* of the second elevator group 250*b* may be extended to help serve landings 125*a*-125*m* of the first range of landings 250*a* and the first elevator group 112*a*. In FIG. 3, the range of landings served by elevators systems 101*f*-101*h* are extended by two landings 125*m*, 125*l* to help serve increased elevator calls 310 to the first elevator group 112*a*. It is understood that FIG. 3 is for exemplary purposes and any number of elevator systems of the second elevator group 112*b* may be extended any number of landings 125.

As shown in the example of FIG. 3 at block 272, if the second elevator group 112*b* is experiencing an increased quantity of elevator calls 310 then the range of landings served by one or more elevators systems 101*d*-101*e* of the first elevator group 112*a* may be extended to help serve landings 125*n*-125*z* of the second range of landings 250*b* and the second elevator group 112*b*. In FIG. 3, the range of landings served by elevators systems 101*d*-101*e* are extended by two landings 125*n*, 125*o* to help serve increased elevator calls 310 to the second elevator group 112*b*. It is understood that FIG. 3 is for exemplary purposes and any number of elevator systems of the first elevator group 112*a* may be extended any number of landings 125. In one embodiment, both block 270 and 270 are added. In another embodiment, only block 270 is added. In yet another embodiment, only block 272 is added.

The redirector 110 may also be configured to adjust the range of landings served by one or more elevator systems 101 in accordance with a preset schedule by the time of day (i.e., known traffic patterns due to history) or in accordance with the prevailing traffic pattern.

Figure 4:
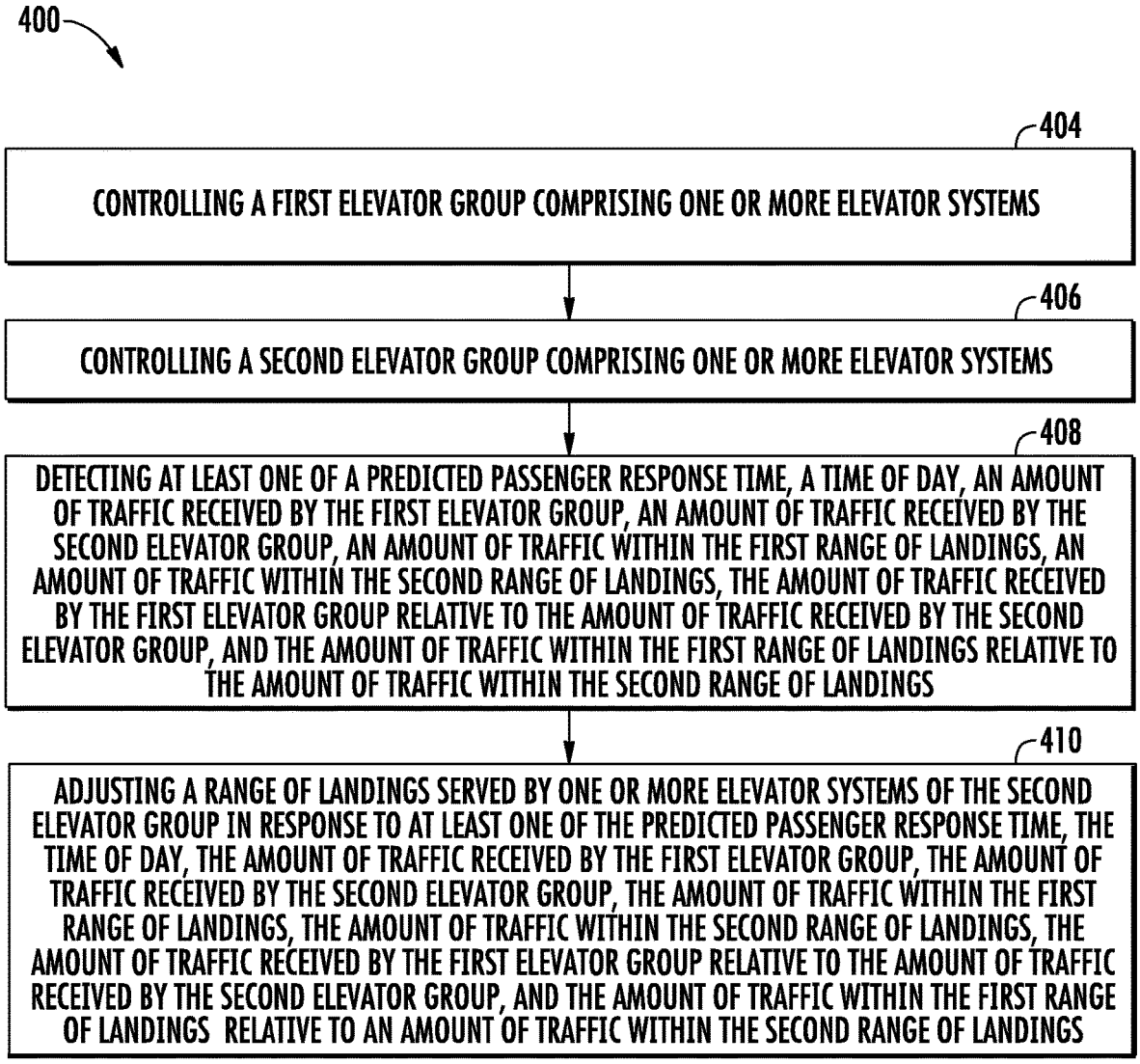
FIG. 4 is a flow chart of method of operating a building elevator system, in accordance with an embodiment of the disclosure.

Referring now to FIG. 4, while referencing components of FIGS. 1-3. FIG. 4 shows a flow chart of method 400 of operating a building elevator system 100 within a building 102 having a plurality of landings 125, in accordance with an embodiment of the disclosure. In an embodiment, the method 400 may be performed by the redirector 110.

At block 404, a first elevator group 112*a* comprising one or more elevator system 101*a*-101*e* is controlled. Each of the one or more elevator systems 101*a*-101*e* of the first elevator group 112*a* comprises an elevator car 103*a*-103*e* configured to serve a first range of landings 250*a*.

At block 406, a second elevator group 112*b* comprising one or more elevator system 101*f*-101*j* is controlled. Each of the one or more elevator systems 101*f*-101*j* of the second elevator group 112*b* comprises an elevator car 103*f*-103*j* configured to serve a second range of landings 250*b*. In an embodiment, the first range of landings 250*a* does not include landings within the second range of landings 250*b* with the exception of an egress landing 125*a*.

In another embodiment, first range of landings 250*a* is a lower range of landings and the second range of landings 250*b* is a higher range of landings located at a higher elevation than the lower range of landings with the exception of an egress landing 125*a*.

At block 408, at least one of a predicted passenger response time, a time of day, an amount of traffic received by the first elevator group 112*a*, an amount of traffic received by the second elevator group 112*b*, an amount of traffic within the first range of landings 250*a*, an amount of traffic within the second range of landings 250*b*, the amount of traffic received by the first elevator group 112*a* relative to the amount of traffic received by the second elevator group 112*b*, and the amount of traffic within the first range of landings 250*a* relative to the amount of traffic within the second range of landings 250*b* is detected.

The predicted passenger response time (e.g., waiting time or time to destination) could be based on the conditions of each elevator system 101 within an elevator group 250*a*-250*b* at the time of the call. The predicted passenger response time to a new call for given elevator system 101 may be calculated so that it is understand the likely waiting time (or time to destination) if an elevator call were to be assigned to the elevator system 101. The general application of a predicted passenger response time calculation is by running that calculation through each of the eligible elevator systems 101*a*-101*j* at the time when an elevator call 310 is received. Note that a less computationally-intensive predicted passenger response time could be based purely on the time of day by learning the response times from historical data.

For example, the decision on whether or not to consider an elevator car 103*f*-103*h* to receive a call involving landing 125*l*-125*m* might be based on predicting the response time to serve a given elevator call 310. If one of elevator systems 101*a*-101*e* can best serve the elevator call 310, then the elevator call 310 should be assigned to one of those elevator systems 101*a*-101*e;* whereas, if one of the elevator systems 101*f*-101*h* can best serve the elevator call 310, the elevator call 310 should be assigned accordingly. There may be variations, such as if the predicted passenger response time by service from elevator systems 101*a*-101*e* is within an acceptable threshold, then assign to one of those elevator systems 101*a*-101*e* but otherwise, consider the predicted passenger response time of elevator systems 101*f*-101*h* as well when block 270 is enabled.

The amount of traffic may be based on the volume of elevator car 103 traffic within a timeframe. For example, the amount of traffic could be the total volume of traffic within the timeframe, the volume of traffic from an origin landing within the time frame, the volume of traffic to a destination floor within the timeframe, the volume of traffic between a subset of landings to another subset of landings within the timeframe. The amount of traffic may also be not just a volume, but also a relative proportion of elevator car 103 traffic. In the example of FIG. 3, it could consider the relative amount of traffic between the first range of landings 250*a* and the second range of landings 250*b*. For example, if there is an unusually high proportion of traffic within the first range of landings 250*a*, then block 270 may be utilized to allow some of the elevators 101*f*-101*h* to serve some of the traffic to or from landings 125*l*-125*m*.

At block 410, a range of landings 125 (e.g., see block 270 in FIG. 3) served by one or more elevator systems 1013*f*-101*h* of the second elevator group 112*b* is adjusted in response to at least one of the predicted passenger response time, the time of day, the amount of traffic received by the first elevator group 112*a*, the amount of traffic received by the second elevator group 112*b*, the amount of traffic within the first range of landings 250*a*, the amount of traffic within the second range of landings 250*b*, the amount of traffic received by the first elevator group 112*a* relative to the amount of traffic received by the second elevator group 112*b*, and the amount of traffic within the first range of landings 250*a* relative to the amount of traffic within the second range of landings 250*b*. The method 400 may further comprise: receiving an elevator call for a landing 125*m*-125*l* within the first range of landings 250*a;* and moving an elevator car 103*f*-103*h* of the one or more elevator systems 101*f*-101*h* of the second elevator group 112*b* to the landing 125*m*-125*l* within the first range of landings 250*a*. The "receiving an elevator call for a landing 125*m*-125*l* within the first range of landings 250*a*" may include both if the origin is within the first range of landings 250*a* and/or if the destination is within the first range of landings 250*a*.

The method 500 may further comprise: receiving an elevator call for a landing 125*m*-125*l* within the first range of landings 250*a;* determining an elevator car 103*a*-103*e* of the one or more elevator systems 101*a*-101*e* of the first elevator group 112*a* or an elevator car 103*f*-103*h* of the one or more elevator systems 101*f*-101*h* of the second elevator group 112*b* to best serve the elevator call 310 in response to a relative amount of traffic with the first range of landings 250*a* and the second range of landings 210; and moving the elevator car determined to the landing 125*m*-125*l* within the first range of landings 250*a*.

In an embodiment, the range of landings served by one or more elevator systems 101 of the second elevator group 112*b* may be adjusted to serve one or more landings gravitationally above the second range of landings 250*b* and/or gravitationally below the second range of landings 250*b*. In another embodiment, the range of landings served by one or more elevator systems 101 of the second elevator group 112*b* may be adjusted to serve one or more landings of the first range of landings 250*a*.

While the above description has described the flow process of FIG. 4 in a particular order, it should be appreciated that unless otherwise specifically required in the attached claims that the ordering of the steps may be varied.

Figure 5:
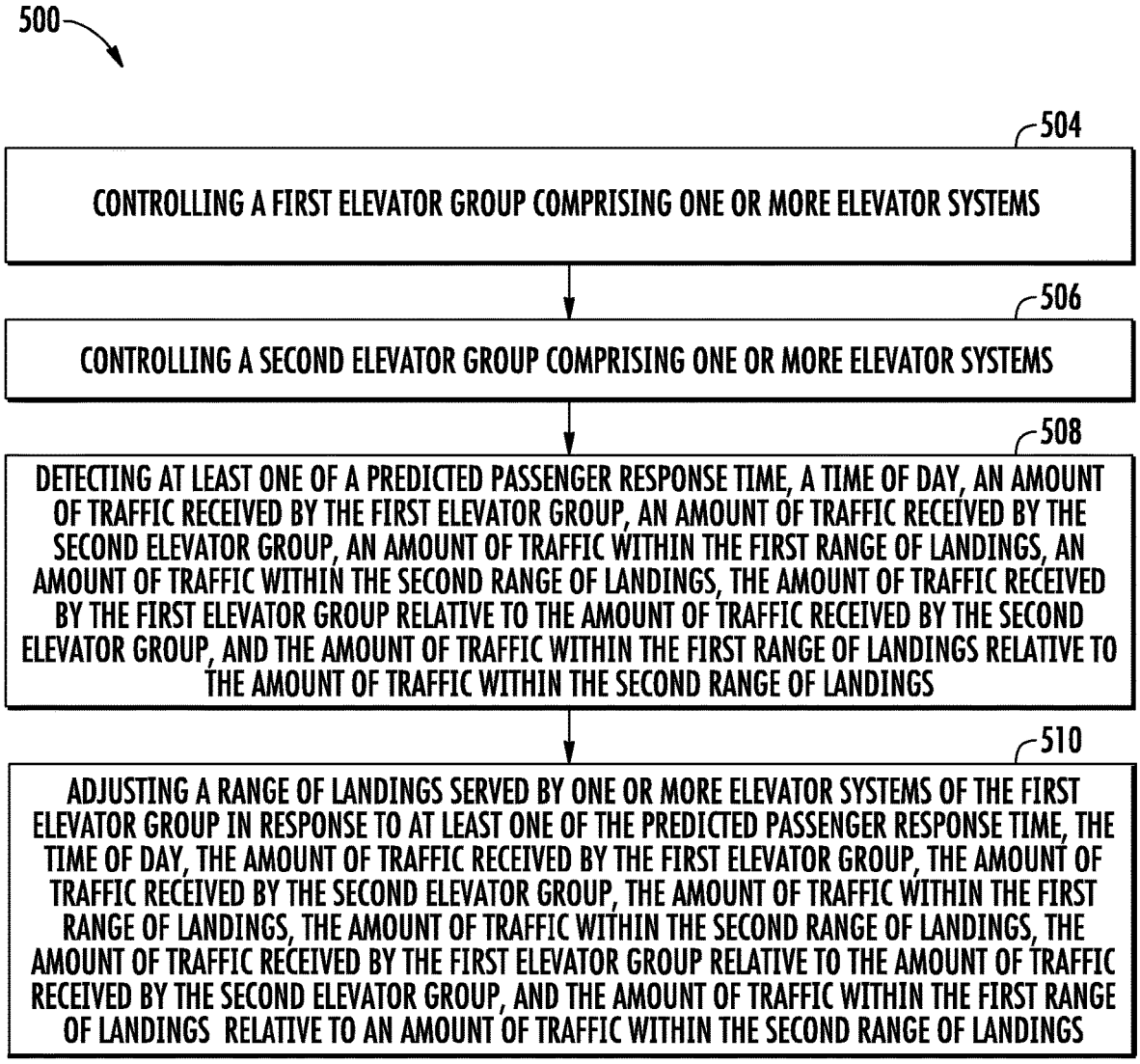
FIG. 5 is a flow chart of method of operating a building elevator system, in accordance with an embodiment of the disclosure.

Referring now to FIG. 5, while referencing components of FIGS. 1-3. FIG. 5 shows a flow chart of method 500 of operating a building elevator system 100 within a building 102 having a plurality of landings 125, in accordance with an embodiment of the disclosure. In an embodiment, the method 500 may be performed by the redirector 110.

At block 504, a first elevator group 112*a* comprising one or more elevator system 101*a*-101*e* is controlled. Each of the one or more elevator systems 101*a*-101*e* of the first elevator group 112*a* comprises an elevator car 103*a*-103*e* configured to serve a first range of landings 250*a*.

At block 506, a second elevator group 112*b* comprising one or more elevator system 101*f*-101*j* is controlled. Each of the one or more elevator systems 101*f*-101*j* of the second elevator group 112*b* comprises an elevator car 103*f*-103*j* configured to serve a second range of landings 250*b*. In an embodiment, the first range of landings 250*a* does not include landings within the second range of landings 250*b* with the exception of an egress landing 125*a*.

In another embodiment, first range of landings 250*a* is a lower range of landings and the second range of landings 250*b* is a higher range of landings located at a higher elevation than the lower range of landings with the exception of an egress landing 125*a*.

At block 508, at least one of a predicted passenger response time, a time of day, an amount of traffic received by the first elevator group 112*a*, an amount of traffic received by the second elevator group 112*b*, an amount of traffic within the first range of landings 250*a*, an amount of traffic within the second range of landings 250*b*, the amount of traffic received by the first elevator group 112*a* relative to the amount of traffic received by the second elevator group 112*b*, and the amount of traffic within the first range of landings 250*a* relative to the amount of traffic within the second range of landings 250*b*. At block 510, a range of landings 125 (e.g., see block 272 in FIG. 3) served by one or more elevator systems 101*d*-101*e* of the first elevator group 112*a* is adjusted in response to at least one of the predicted passenger response time, the time of day, the amount of traffic received by the first elevator group 112*a*, the amount of traffic received by the second elevator group 112*b*, the amount of traffic within the first range of landings 250*a*, the amount of traffic within the second range of landings 250*b*, the amount of traffic received by the first elevator group 112*a* relative to the amount of traffic received by the second elevator group 112*b*, and the amount of traffic within the first range of landings 250*a* relative to the amount of traffic within the second range of landings 250*b*. The method 500 may further comprise: receiving an elevator call for a landing 125*n*-125*o* within the second range of landings 250*b*; and moving an elevator car 103*d*-103*e* of the one or more elevator systems 101*d*-101*e* of the first elevator group 112*a* to the landing 125*n*-125*o* within the second range of landings 250*b*. The method 500 may further comprise: receiving an elevator call 310 for a landing 125*n*-125*o* within the second range of landings 250*b*; determining an elevator car 103*d*-103*e* of the one or more elevator systems 101*d*-101*e* of the first elevator group 112*a* or an elevator car 103*f*-103*j* of the one or more elevator systems 101*f*-101*j* of the second elevator group 112*b* to best serve the elevator call 310 in response to a relative amount of traffic with the first range of landings 250*a* and the second range of landings 250*b*; and moving the elevator car determined to the landing 125*n*-125*o* within the second range of landings 250*b*.

In an embodiment, the range of landings served by one or more elevator systems 101 of the first elevator group 112*a* may be adjusted to serve one or more landings gravitationally above the first range of landings 250*a* and/or gravitationally below the first range of landings 250*a*. In another embodiment, the range of landings served by one or more elevator systems 101 of the first elevator group 112*a* may be adjusted to serve one or more landings of the second range of landings 250*b*.

While the above description has described the flow process of FIG. 5 in a particular order, it should be appreciated that unless otherwise specifically required in the attached claims that the ordering of the steps may be varied.

As described above, embodiments can be in the form of processor-implemented processes and devices for practicing those processes, such as processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes a device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of operating a building elevator system within a building having a plurality of landings, the method comprising:

controlling a first elevator group comprising one or more elevator systems, wherein each of the one or more elevator systems of the first elevator group comprises an elevator car configured to serve a first range of landings;

controlling a second elevator group comprising one or more elevator systems, wherein each of the one or more elevator systems of the second elevator group comprise an elevator car configured to serve a second range of landings;

detecting at least one of a predicted passenger response time, a time of day, an amount of traffic received by the first elevator group, an amount of traffic received by the second elevator group, an amount of traffic within the first range of landings, an amount of traffic within the second range of landings, the amount of traffic received by the first elevator group relative to the amount of traffic received by the second elevator group, and the amount of traffic within the first range of landings relative to the amount of traffic within the second range of landings; and adjusting a range of landings served by one or more elevator systems of the second elevator group in response to at least one of the predicted passenger response time, the time of day, the amount of traffic received by the first elevator group, the amount of traffic received by the second elevator group, the amount of traffic within the first range of landings, the amount of traffic within the second range of landings, the amount of traffic received by the first elevator group relative to the amount of traffic received by the second elevator group, and the amount of traffic within the first range of landings relative to an amount of traffic within the second range of landings, wherein the first range of landings is a lower range of landings and the second range of landings is a higher range of landings that extends to a higher elevation than the lower range of landings, or wherein the second range of landings is a lower range of landings and the first range of landings is a higher range of landings that extends to a higher elevation than the lower range of landings.

2. The method of claim 1, wherein the range of landings served by one or more elevator systems of the second elevator group is adjusted to serve one or more landings gravitationally above the second range of landings.

3. The method of claim 1, wherein the range of landings served by one or more elevator systems of the second elevator group is adjusted to serve one or more landings gravitationally below the second range of landings.

4. The method of claim 1, wherein the range of landings served by one or more elevator systems of the second elevator group is adjusted to serve one or more landings of the first range of landings.

5. The method of claim 1, wherein prior to adjusting a range of landings the first range of landings does not include landings within the second range of landings with the exception of an egress landing.

6. The method of claim 1, further comprising:

receiving an elevator call for a landing within the first range of landings; and moving an elevator car of the one or more elevator systems of the second elevator group to the landing within the first range of landings.

7. The method of claim 1, further comprising:

receiving an elevator call for a landing within the first range of landings;

determining an elevator car of the one or more elevator systems of the first elevator group or an elevator car of the one or more elevator systems of the second elevator group to best serve the elevator call in response to a relative amount of traffic with the first range of landings and the second range of landings; and moving the elevator car determined to the landing within the first range of landings.

8. A method of operating a building elevator system within a building having a plurality of landings, the method comprising:

controlling a first elevator group comprising one or more elevator systems, wherein each of the one or more elevator systems of the first elevator group comprises an elevator car configured to serve a first range of landings;

controlling a second elevator group comprising one or more elevator systems, wherein each of the one or more elevator systems of the second elevator group comprise an elevator car configured to serve a second range of landings;

detecting at least one of a predicted passenger response time, a time of day, an amount of traffic received by the first elevator group, an amount of traffic received by the second elevator group, an amount of traffic within the first range of landings, an amount of traffic within the second range of landings, the amount of traffic received by the first elevator group relative to the amount of traffic received by the second elevator group, and the amount of traffic within the first range of landings relative to the amount of traffic within the second range of landings; and adjusting a range of landings served by one or more elevator systems of the first elevator group in response to at least one of the predicted passenger response time, the time of day, the amount of traffic received by the first elevator group, the amount of traffic received by the second elevator group, the amount of traffic within the first range of landings, the amount of traffic within the second range of landings, the amount of traffic received by the first elevator group relative to the amount of traffic received by the second elevator group, and the amount of traffic within the first range of landings relative to an amount of traffic within the second range of landings, wherein the first range of landings is a lower range of landings and the second range of landings is a higher range of landings that extends to a higher elevation than the lower range landings, or wherein the second range of landings is a lower range of landings and the first range of landings is a higher range of landings that extends to a higher elevation that the lower range of landings.

9. The method of claim 8, wherein the range of landings served by one or more elevator systems of the first elevator group is adjusted to serve one or more landings gravitationally above the first range of landings.

10. The method of claim 8, wherein the range of landings served by one or more elevator systems of the first elevator group is adjusted to serve one or more landings gravitationally below the first range of landings.

11. The method of claim 8, wherein the range of landings served by one or more elevator systems of the first elevator group is adjusted to serve one or more landings of the second range of landings.

12. The method of claim 8, wherein prior to adjusting a range of landings the first range of landings does not include landings within the second range of landings with the exception of an egress landing.

13. The method of claim 8, further comprising:

receiving an elevator call for a landing within the second range of landings; and moving an elevator car of the one or more elevator systems of the first elevator group to the landing within the second range of landings.

14. The method of claim 8, further comprising:

receiving an elevator call for a landing within the second range of landings;

determining an elevator car of the one or more elevator systems of the first elevator group or an elevator car of the one or more elevator systems of the second elevator group to best serve the elevator call in response to a relative amount of traffic with the first range of landings and the second range of landings; and moving the elevator car determined to the landing within the second range of landings.

15. A building elevator system comprising:

a processor;

a memory comprising computer-executable instructions that, when executed by the processor, cause the processor to perform operations, the operations comprising:

controlling a first elevator group comprising one or more elevator systems, wherein each of the one or more elevator systems of the first elevator group comprises an elevator car configured to serve a first range of landings;

controlling a second elevator group comprising one or more elevator systems, wherein each of the one or more elevator systems of the second elevator group comprise an elevator car configured to serve a second range of landings;

detecting at least one of a predicted passenger response time, a time of day, an amount of traffic received by the first elevator group, an amount of traffic received by the second elevator group, an amount of traffic within the first range of landings, an amount of traffic within the second range of landings, the amount of traffic received by the first elevator group relative to the amount of traffic received by the second elevator group, and the amount of traffic within the first range of landings relative to the amount of traffic within the second range of landings; and adjusting a range of landings served by one or more elevator systems of the second elevator group in response to at least one of the predicted passenger response time, the time of day, the amount of traffic received by the first elevator group, the amount of traffic received by the second elevator group, the amount of traffic within the first range of landings, the amount of traffic within the second range of landings, the amount of traffic received by the first elevator group relative to the amount of traffic received by the second elevator group, and the amount of traffic within the first range of landings relative to an amount of traffic within the second range of landings, wherein the first range of landings is a lower range of landings and the second range of landings is a higher range of landings that extends to a higher elevation than the lower range of landings, or wherein the second range of landings is a lower range of landings and the first range of landings is a higher rnage of landings that extends to a higher elevation than the lower range of landings.

16. The building elevator system of claim 15, wherein the range of landings served by one or more elevator systems of the second elevator group is adjusted to serve one or more landings gravitationally above the second range of landings.

17. The building elevator system of claim 15, wherein the range of landings served by one or more elevator systems of the second elevator group is adjusted to serve one or more landings gravitationally below the second range of landings.

18. The building elevator system of claim 15, wherein the range of landings served by one or more elevator systems of the second elevator group is adjusted to serve one or more landings of the first range of landings.

* * * * *